United States Patent [19]

Kawaguchi et al.

[11] Patent Number: 4,636,152

[45] Date of Patent: Jan. 13, 1987

[54] ROTARY COMPRESSOR

[75] Inventors: Susumu Kawaguchi; Takuho Hirahara; Kazuhiro Nakane, all of Shizuoka; Sei Ueda, Shimizu, all of Japan

[73] Assignee: Mitsubishi Denki Kabushiki Kaisha, Tokyo, Japan

[21] Appl. No.: 760,627

[22] Filed: Jul. 30, 1985

[30] Foreign Application Priority Data

Aug. 22, 1984 [JP] Japan ..... 59-174562

[51] Int. Cl.[4] ..... F01C 1/063

[52] U.S. Cl. ..... 418/54; 418/63

[58] Field of Search ..... 418/63–67, 418/54, 270

[56] References Cited

U.S. PATENT DOCUMENTS 3,082,937 3/1963 Tucker ..... 418/63

3,105,633 10/1963 Dellario ..... 418/63

FOREIGN PATENT DOCUMENTS 24260 9/1961 Japan .

*Primary Examiner*—Carlton R. Croyle

*Assistant Examiner*—Jane E. Obee

*Attorney, Agent, or Firm*—Oblon, Fisher, Spivak, McClelland & Maier

[57] ABSTRACT

An eccentric part of a crank shaft rotated in a cylinder is made large in diameter and a thin-walled rolling piston is fitted to the outer circumference of the eccentric part so that an injection opening for supplying a refrigerant into the cylinder, the opening being formed in a bearing plate, is covered by only a side surface of the rolling piston or both the side surfaces of the rolling piston and the eccentric part.

3 Claims, 4 Drawing Figures

FIGURE 1
PRIOR ART
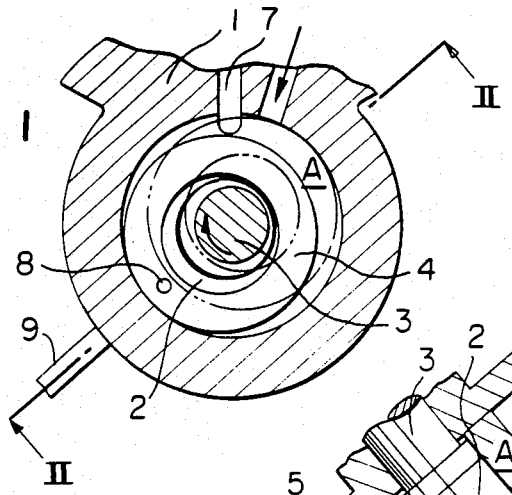
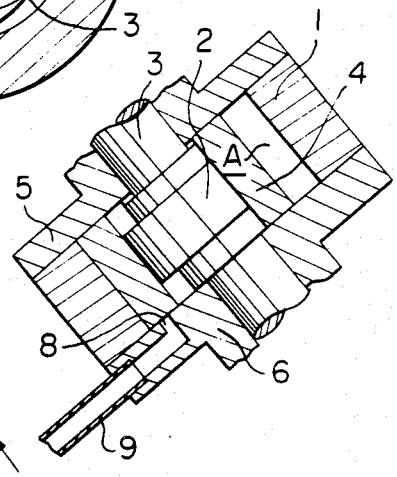
FIGURE 2
PRIOR ART
FIGURE 3
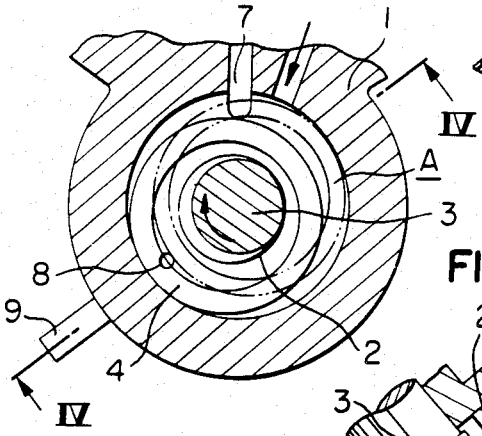
FIGURE 4
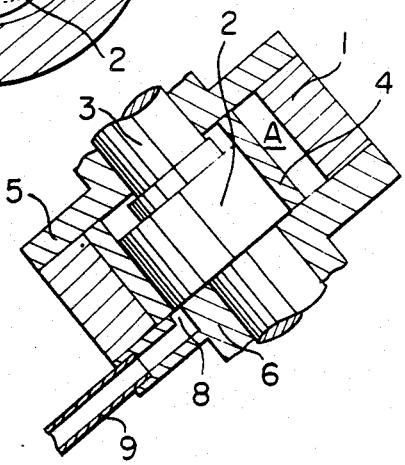

ROTARY COMPRESSOR

BACKGROUND OF THE INVENTION

The present invention relates to a rotary compressor. More particularly, it relates to a rotary compressor of a type that an injection opening is formed in a bearing plate for a crank shaft for driving a rolling piston to supply a refrigerant into a compression chamber.

FIGS. 1 and 2 are cross-sectional view showing an important part of a conventional rotary compressor as shown in Japanese Unexamined Patent Publication No. 24260/1964. As shown in FIGS. 1 and 2, the conventional rotary compressor is so constructed that a crank shaft 3 having an eccentric part 2 is driven in a cylinder 1 by a motor so that a rolling piston 4 fitted to the eccentric part 2 is subjected to eccentric rotation in the cylinder 1 to thereby compress a refrigerant gas sucked in the cylinder 1. The crank shaft 3 is passed through and rotatably supported by both outer bearing plates 5, 6. A compression chamber A is formed between the both outer bearing plates 5, 6, inside the cylinder 1 and a vane 7 which is slidably held by the cylinder 1 and has an end portion being in contact with the outer circumferential surface of the rolling piston 4. An injection opening 8 for supplying the refrigerant into the compression chamber A is formed in either bearing plate, e.g. the bearing plate 6. The injection opening 8 is communicated with an exterior refrigerant circulating circuit through a piping 9.

In the conventional rotary compressor, the injection opening 8 is closed by only a side surface of the rolling piston 4 fitted to the crank shaft 3. Accordingly, it is unavoidable that the wall thickness of the rolling piston 4 should be large in consideration of the inner diameter of the injection opening 8. This results in reduction in the inner diameter of the rolling piston 4 from the viewpoint of limitation of the inner diameter of the cylinder 1 thereby causing a small diameter of the eccentric part 2. When the diameter of the eccentric part 2 is small, efficiency in compression operation is poor and application to a compressor having a large capacity has been hindered.

It is an object of the present invention to provide a rotary compressor which allows the diameter of an eccentric part of a crank shaft to be large in comparison with the inner diameter of a cylinder to thereby increase compression efficiency.

The foregoing and the other objects of the present invention have been attained by a rotary compressor comprising a crank shaft for driving a rolling piston and bearing plates to support the crank shaft in which an injection opening is formed in at least one bearing plate to supply a refrigerant into a compression chamber formed inside the bearing plate, characterized in that the crank shaft has an eccentric part in the compression chamber; the eccentric part has a diameter which reaches a position of the injection opening during the revolution of said crank shaft and the eccentric part has a side surface in slide-contact with a bearing plate in which the injection opening is formed; the rolling piston is rotatably fitted to the outer circumference of the eccentric part and a side surface of the rolling piston is in slide-contact with the bearing plate, whereby the injection opening can be closed by the rolling piston or both the eccentric part and the rolling piston.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a cross-sectional view of an important part of a conventional rotary compressor;

FIG. 2 is a longitudinal cross-sectional view taken along a line II—II in FIG. 1;

FIG. 3 is a cross-sectional view of an important part of an embodiment of the rotary compressor according to the present invention; and FIG. 4 is a longitudinal cross-sectional view taken along a line IV—IV in FIG. 3.

DETAILED DESCRIPTION OF THE PREFERRED EMBODIMENT

An embodiment of the present invention will be described with reference to the drawing, In FIGS. 3 and 4, a rotary compressor of an embodiment of the present invention is provided with a cylinder 1 in which a crank shaft 3 having an eccentric part 2 is rotatably supported. The crank shaft 3 is driven by a motor and a rolling piston 4 of a ring form having a thin wall which is fitted to the outer circumferential surface of the eccentric part 2 is subjected to eccentric rotation in the cylinder 1 to thereby compress a refrigerant gas sucked in the cylinder 1. One side surface of the eccentric part 2 is in slide-contact with an inner surface of a bearing plate 6 in which an injection opening 8 is formed to supply the refrigerant gas into a compression chamber A. The compression chamber A is formed by the inner circumference of the cylinder 1, bearing plates 5, 6 attached to both sides of the cylinder 1 to support the crank shaft 3 and a vane 7 extending from the inner circumference of the cylinder 1 between the bearing plates 5, 6, the top end of the vane 7 being in slide-contact with the outer circumference of the rolling piston 4. The injection opening 8 is formed in the bearing plate 6 in such a position that when the rolling piston reaches a position where a compression stroke or step for the refrigerant gas is nearly finished, immediately before the volume of the compression chamber reacts a minimum value, the circular edge of the injection opening comes to the outer circumferential edge of the rolling piston 4 to uncover the injection opening, and when the rolling piston reaches a position 180° advancing from the former position, the injection opening is closed by the side surface of the eccentric part 2 and the side surface of the rolling piston 4. Thus, during one revolution of the crank shaft 3 in the cylinder 1, there are sections that the injection opening 8 is closed solely by the side surface of the rolling piston 4 and by both the side surfaces of the rolling piston 4 and the eccentric part 2. The injection opening 8 is communicated with a refrigerant circulating circuit provided outside of the compressor through a piping 9.

With the construction as above-mentioned, the wall thickness of the rolling piston can be reduced with the result of increasing the diameter of the eccentric part of the crank shaft 3, whereby the wall thickness of the rolling piston 4 can be reduced in comparison with a conventional rotary compressor. Accordingly, the construction as above-mentioned is applicable to a compressor having a large capacity to increase the efficiency of compression. Further, it is possible to increase effect of injection of the refrigerant by making the diameter of the injection opening larger than the conventional opening.

In accordance with the rotary compressor of the present invention, coverage of the injection opening for supplying the refrigerant into the compression chamber is performed by only the rolling piston or by both the rolling piston and the eccentric part. Accordingly, there is no need to reduce the wall thickness of the rolling piston as is the case in the conventional one and the diameter of the eccentric part of the crank shaft can be made larger depending on the reduced wall thickness of the rolling piston. The increased diameter of the eccentric part increases efficiency of compression and improves effect of the injection by determining a larger injection opening in comparison with one of the conventional type. Further, in the present invention, there is formed a section that a part of the injection opening is closed by utilizing the eccentric part of the crank shaft, thereby allowing application to a compressing device having a large eccentricity (a large capacity) in the eccentric part of a crank shaft.

We claim:

1. A rotary compressor, comprising:

a cylinder having bearing plates at axial ends thereof;

a rotatable crank shaft extending axially through said cylinder, said crank shaft having an eccentric part in said cylinder;

a rolling piston fitted around said eccentric part in said cylinder;

a vane extending from said cylinder to said rolling piston, whereby a variable volume compression chamber is defined by said cylinder, said vane, said bearing plates and said rolling piston;

gas inlet means having an injection opening in at least one of said bearing plates for communication with said compression chamber; and gas outlet means for discharging compressed gas from said compression chamber, wherein said eccentric part and said rolling piston are in slide contact with each said at least one bearing plate having said injection opening therein, and wherein each said injection opening is radially positioned on a respective said bearing plate such that said injection opening is closed by both said rolling piston and said eccentric part during a portion of each revolution of said crank shaft.

2. The rotary compressor of claim 4, wherein each said injection opening is uncovered by said rolling piston and said eccentric part immediately before the volume of said compression chamber reaches a minimum value as a result of the rotation of said crankshaft.

3. The rotary compressor according to claim 2 wherein said rolling piston is a thin-walled ring body.

* * * * *